US005174592A

United States Patent [19]

Pool

[11] Patent Number: 5,174,592

[45] Date of Patent: Dec. 29, 1992

[54] LOW PROFILE MECHANIC'S CREEPER

[75] Inventor: James L. Pool, Clarinda, Iowa

[73] Assignee: Lisle Corporation, Clarinda, Iowa

[21] Appl. No.: 567,725

[22] Filed: Aug. 15, 1990

Related U.S. Application Data

[63] Continuation of Ser. No. 305,444, Feb. 2, 1989, abandoned.

[51] Int. Cl.[5] ..... B25H 5/00

[52] U.S. Cl. ..... 280/32.6

[58] Field of Search ..... 280/32.5, 32.6

[56] References Cited

U.S. PATENT DOCUMENTS

| | | | |
|---|---|---|---|
| D. 271,717 | 12/1983 | Linn | D34/17 |
| 1,104,398 | 7/1914 | Zimmerman | 280/32.6 |
| 1,132,983 | 3/1915 | Shuey | 280/32.6 |
| 1,177,340 | 3/1916 | Klein | 180/274 |
| 1,184,487 | 5/1916 | Peterson | 280/32.6 |
| 1,302,301 | 4/1919 | Broome | 280/32.6 |
| 1,349,941 | 8/1920 | Broome | 280/32.6 |
| 1,363,023 | 12/1920 | Taylor | 280/32.6 |
| 1,385,877 | 7/1921 | McDonald | 188/6 |
| 1,446,945 | 2/1923 | Sunderland | 280/32.6 |
| 1,769,548 | 7/1930 | Rodin | 280/32.6 |
| 2,084,957 | 6/1937 | Hulbert | 280/32.6 |
| 2,148,199 | 2/1939 | Heckman | 280/32.6 |
| 2,154,952 | 4/1939 | Mahloch | 280/32.6 |
| 2,246,628 | 6/1941 | Heckman | 280/32.6 |
| 2,288,568 | 6/1942 | Holmes | 280/32.6 |
| 2,291,094 | 7/1942 | McCarthy | 362/61 |
| 2,456,002 | 12/1948 | Jonette | 280/605 |
| 2,487,706 | 11/1949 | Happ | 280/32.6 |
| 2,716,181 | 9/1955 | Ritter | 219/217 |
| 2,782,045 | 2/1957 | Hulbert | 280/32.6 |
| 3,092,394 | 6/1963 | Burke | 280/32.6 |
| 3,313,377 | 4/1967 | Aninger | 188/5 |
| 3,361,437 | 1/1968 | Loftis | 280/32.6 |
| 4,043,566 | 8/1977 | Johnson | 280/87.042 |
| 4,066,151 | 1/1978 | Liebscher et al. | 188/5 |
| 4,168,076 | 9/1979 | Johnson | 280/11.2 |
| 4,244,594 | 1/1981 | Hines | 280/32.6 |
| 4,489,837 | 12/1984 | Adair | 211/86 |
| 4,570,957 | 2/1986 | Rose | 280/32.6 |
| 4,698,731 | 10/1987 | Johns, Sr. | 361/61 |
| 4,875,694 | 10/1989 | Hamrick | 280/32.6 |

FOREIGN PATENT DOCUMENTS

| | | | |
|---|---|---|---|
| 0481275 | 2/1952 | Canada | 280/32.6 |
| 0628895 | 4/1927 | France | 280/32.6 |
| 2198994 | 6/1988 | United Kingdom | 280/32.6 |

OTHER PUBLICATIONS

Lisle Corporation, 807 E. Main St., Clarinda, Iowa 51632, discloses 2 Sales Catalogs of Creepers and accessories (see pp. 36–38 and pp. 28–29).

JAY-NIC Enterprises, 22963 Sawmill Flat Road, Sonora, Calif. 95370, discloses a Sales Catalog including several Creepers.

*Primary Examiner*—Mitchell J. Hill

*Attorney, Agent, or Firm*—Allegretti & Witcoff, Ltd.

[57] ABSTRACT

An improved mechanic's creeper includes a closed loop, unitary metal frame supported by heavy duty casters recessed at spaced intervals in the frame. The frame is comprised of a single, closed loop rectangular shape, and a single cross member attached to opposite sides of the frame to assist in support of a platform. The creeper is thus configured to define a low profile while minimizing any obstructions to the user's field of motion.

1 Claim, 3 Drawing Sheets

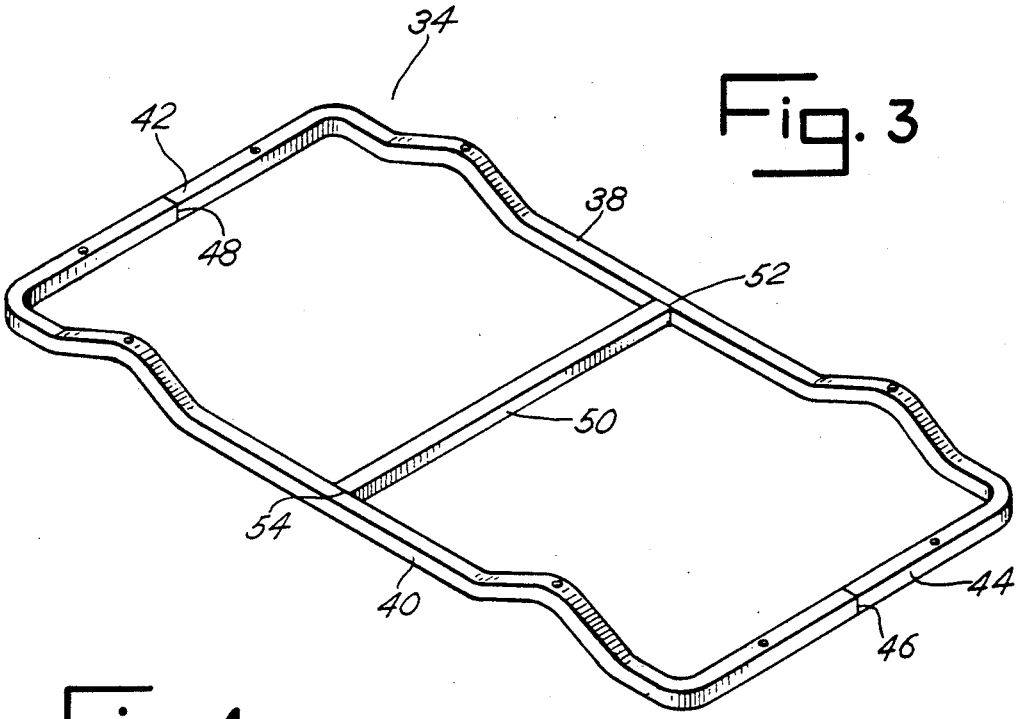
Fig. 3
Fig. 4
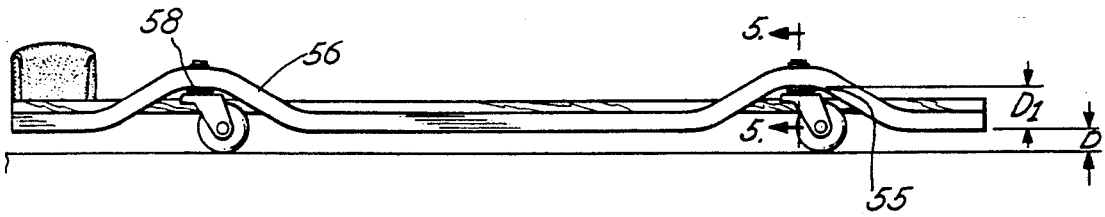
Fig. 5
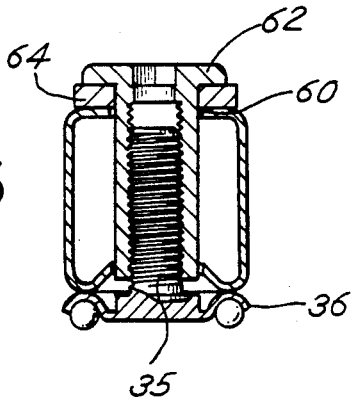

LOW PROFILE MECHANIC'S CREEPER

This application is a continuation of application Ser. No. 7/305,444, filed Feb. 2, 1989, now abandoned.

BACKGROUND OF THE INVENTION

The present invention relates to an improved mechanic's creeper of the type designed to permit a person to work while assuming a reclined position.

U.S. Pat. No. 4,570,957 issued Feb. 18, 1986, entitled "Mechanic's Creeper" in the name of Rose discloses a mechanic's creeper with a low profile. The creeper disclosed by Rose also comprises a heavy duty frame having several support members affixed to a primary support structure that requires many welding operations in the manufacturing process. In order to realize low ground clearance Rose employs light duty casters with an angled rotation axis.

U.S. Pat. No. 1,769,548 issued Jul. 1, 1930, entitled "Auto Creeper" in the name of Rodin discloses a mechanic's creeper with a low profile frame. The frame disclosed by Rodin embodies a recess for mounting casters, yet construction of the frame requires welding many support members and brackets in the manufacturing process.

U.S. Pat. No. 2,288,568 issued Jun. 30, 1942, entitled "Creeper" in the name of Holmes also discloses a mechanic's creeper with a low profile frame having recesses for receiving casters. The creeper disclosed by Rodin also requires an excessive amount of labor to assemble the many components comprising the frame.

U.S. Pat. No. 1,446,945 issued Feb. 27, 1923, entitled "Rest Or Creeper For Automobile Mechanics" in the name of Sunderland discloses a creeper with a low profile frame having contoured recesses for receiving casters. The creeper disclosed by Sunderland also requires an excessive amount of labor to assemble the many components comprising the frame.

The present invention discloses a low profile creeper having an all metal frame that overcomes the problems noted with respect to the excessive labor required during the assembly process.

SUMMARY OF THE INVENTION

Briefly, the present invention relates to an improved mechanic's creeper of the type designed to receive a person working in a reclined position. The disclosed creeper includes a cradle or platform for supporting the reclined person, a low profile all metal frame assembly upon which the cradle or platform is mounted, and heavy duty casters affixed to the frame assembly to allow the creeper to be positioned in any desired orientation. The low profile frame assembly is comprised of a minimum number of integrally formed components in order to minimize the labor required during manufacture. Specifically the frame assembly includes a generally rectangular unitary frame. The frame is also configured to minimize any obstructions in the user's field of motion and to position a reclined person supported by the creeper close to the floor or other support surface.

Thus, it is an object of the present invention to provide a mechanic's creeper that is mechanically strong.

Another object of the present invention is to provide a mechanic's creeper having a low profile with integrally formed components that minimize obstructions to the user's range of motion.

Another object of the present invention is to provide a mechanic's creeper having a minimum number of components.

A further object of the present invention is to provide a mechanic's creeper that minimizes the labor required during the manufacturing process.

A still further object of the present invention is to provide a mechanic's creeper that is economical to manufacture.

Another object of the invention is to provide a mechanic's creeper which utilizes a generally closed loop, rectangular and unitary frame.

These and other objects, advantages and features of the invention will be set forth in the detailed description which follows.

BRIEF DESCRIPTION OF THE DRAWINGS

In the detailed description of the invention, reference will be made to the drawing comprised of the following figures:

FIG. 3 is a perspective view of the frame of applicant's improved mechanic's creeper shown in FIG. 2:

FIG. 4 is a side elevation view of FIG. 2;

FIG. 5 is a sectional view of FIG. 4 taken along line 5—5;

DESCRIPTION OF THE PREFERRED EMBODIMENT

Figure 1:
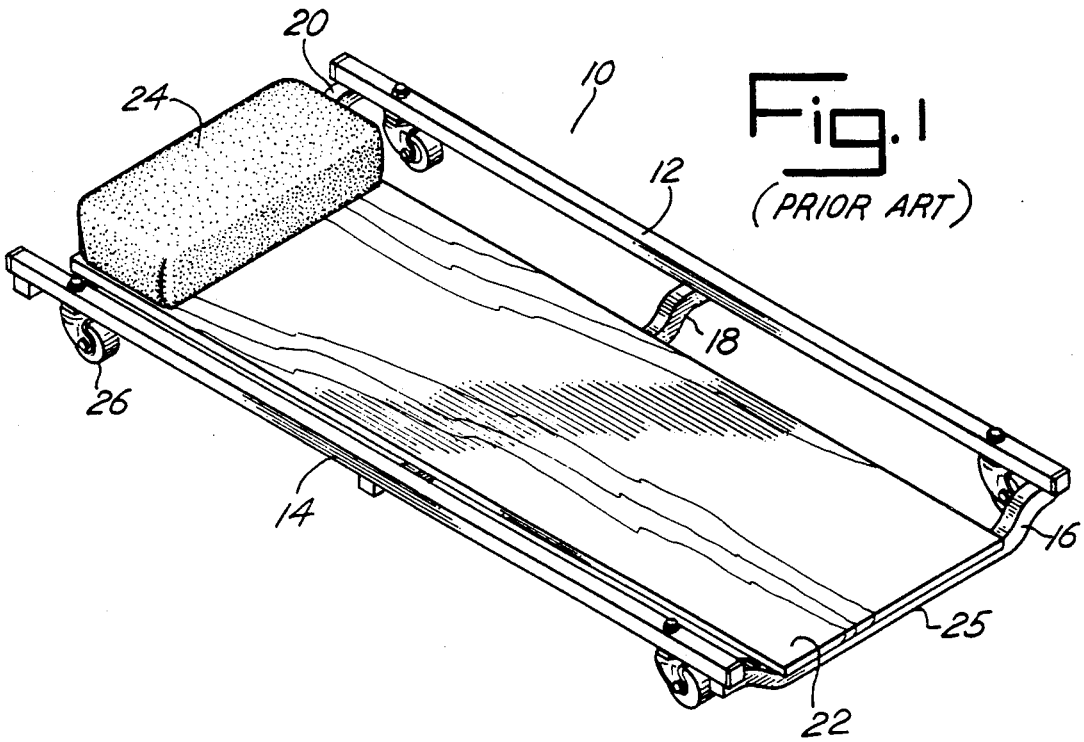
Fig. 1 (PRIOR ART)
FIG. 1 is a perspective view of a prior art mechanic's creeper.

FIG. 1 illustrates a prior art, low profile creeper 10. The creeper 10 includes first and second straight, parallel, spaced side support rails 12 and 14 fabricated from square cross section steel channel. Rails 12 and 14 are connected by three spaced, transverse cross members 16, 18 and 20 also fabricated from square cross section steel channel. Each member 16, 18, and 20 is generally U-shaped in profile with a low profile run 25. Rails 12 and 14 and cross members 16, 18, and 20 thus define a generally rectangular grid or frame assembly for support of a planar sheet or platform 22. A pillow or head support 24 is attached at one end of the platform 22. Platform 22 is bolted to the middle, low profile run 25 to thereby position a person on members 16, 18 and 20 close to the floor. Casters 26 are swivel mounted to rails 12 and 14 at spaced intervals to provide four point support for the creeper. With the prior art creeper of FIG. 1 an individual is cradled below and between rails 12 and 14.

Figure 2:
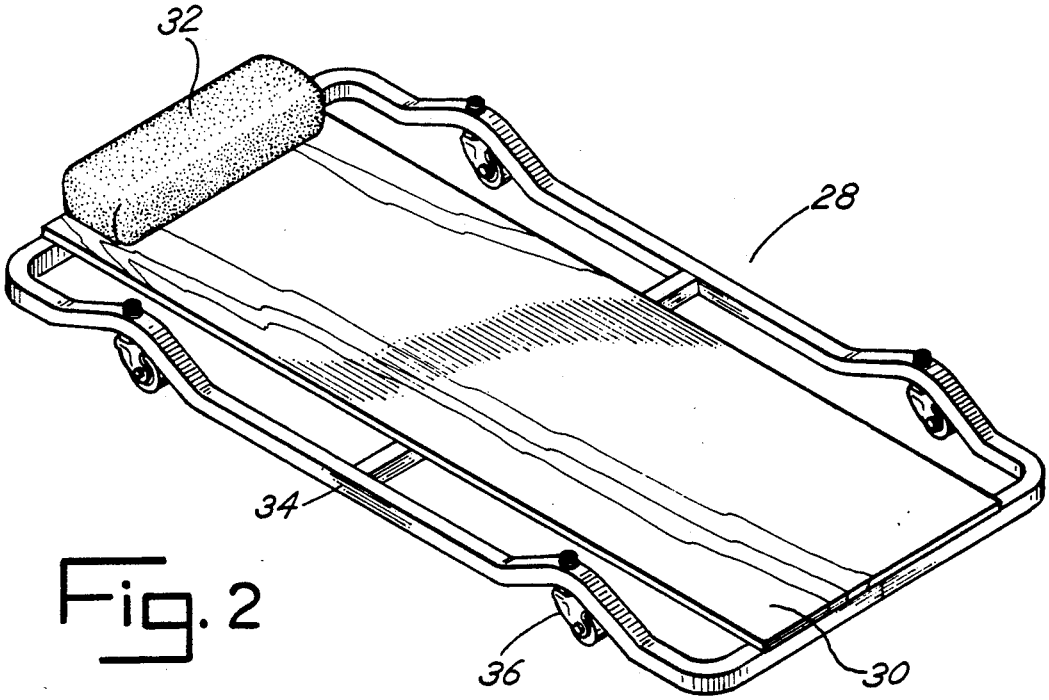
FIG. 2 is a perspective view of a mechanic's creeper embodying the improvements of the present invention.

FIG. 2 depicts the improved creeper of the present invention. As shown in FIG. 2, a typical mechanic's creeper 28 of the type that may embody the improvements of the present invention generally includes a rectangular cradle or platform 30, a head rest 32, a two component low profile frame 34, and casters 36.

FIG. 3 is a detailed illustration of low profile frame 34 shown in FIG. 2. The low profile frame comprises a single, generally rectangular closed loop defined by sides 38 and 40, and ends 42 and 44. In the preferred embodiment, the generally rectangular closed loop defined by sides 38 and 40, and ends 42 and 44 is fabricated from a single section of steel tubing coupled or welded at a single joint 46. However, the generally rectangular closed loop defined by sides 38 and 40, and ends 42 and 44 may also be fabricated from two identical U-shaped sections coupled or welded at joints 46 and 48. A supplemental support member or bracket 50 spans the minor dimension of the generally rectangular closed loop defined by sides 38 and 40, and ends 42 and 44 and is coupled or welded at joints 52 and 54. Joints 46, 48, 52, and 54 may be coupled by means other than welding, such as providing tapered ends to establish a male/-female relationship between adjoining sections. Alternatively, low profile frame 34 comprised of the generally rectangular closed loop defined by sides 38 and 40, and ends 42 and 44 and supplemental support member 50 may be formed by a cast or injection molding process utilizing a metal, a plastic, or a composite material. In the preferred embodiment, frame 34 has dimensions of 42 inches×17 inches and is formed of 0.75 inch square×0.049 inch (18 gauge) wall steel tubing.

FIG. 4 illustrates a side elevation view of low profile frame 34. Sides 38 and 40 of frame 34 include a first and second contoured recess 56 at each corner of the creeper. Each recess has gradually curved corners and a flat section 58 at the apex of recess 56. Casters 36 are mounted to flat section 58 of each recess to provide four corner support for the creeper Mounting casters 36 to sides 38 and 40 of frame 34 provides maximum creeper stability. The dimensions of each recess 56 accommodate a substantial portion of casters 36 to impart a low profile to creeper 28. Thus as shown in FIG. 4, the dimension, D, which represents the support level of the creeper, is minimized by adjusting the depth, $D^1$, of the recess 56. The dimension $D^1$ is thus a function of the caster construction and the desired dimension of creeper height D. alternatively, frame 34 may include additional caster mounting recessess 56 to provide greater creeper support.

FIG. 5 is a sectional view of frame 34 taken at the apex of recess 56 and illustrates the mounting of caster 36 to frame 34. A threaded portion 35 of caster 36 extends into hole 60 formed in flat section 58 of recess 56. A cap nut 62 extends through lock washer 64 into hole 60 from the top side of flat section 58 and engages threaded portion 35 to secure caster 36 to frame 34. Cap nut 62 is of the low profile type to minimize protrusions from creeper 28.

Figure 6:
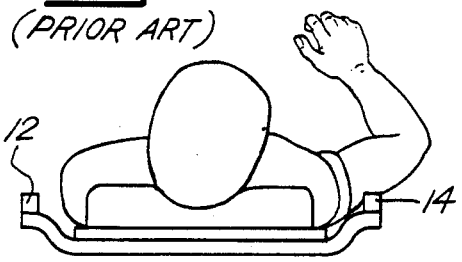
Fig. 6 (PRIOR ART)
FIG. 6 is an end elevation view of FIG. 1.
Figure 7:
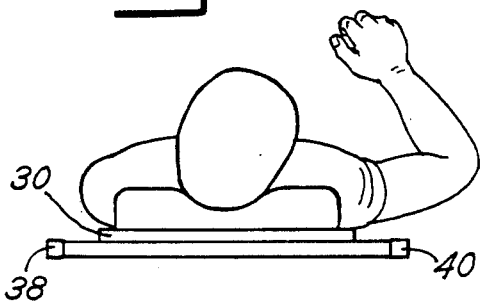
FIG. 7 is an end elevation view of FIG. 2.

FIG. 6 and FIG. 7 illustrate a end elevation view of the prior art creeper of FIG. 1 and applicant's creeper of FIG. 2, respectively. As shown in FIG. 6, support rails 12 and 14 of prior art creeper 10 obstruct the user's range of motion.

As show in FIG. 7, applicant's design minimizes interference of the user's range of motion by contouring frame 34 so that sides 38 and 40 are at or below the level of platform 30.

As shown in FIG. 4, casters 36 are preferably heavy duty casters of the type having a ball bearing swivel assembly 35 with 360 degrees of motion and rubber wheels that are not easily obstructed by debris.

Figure 8:
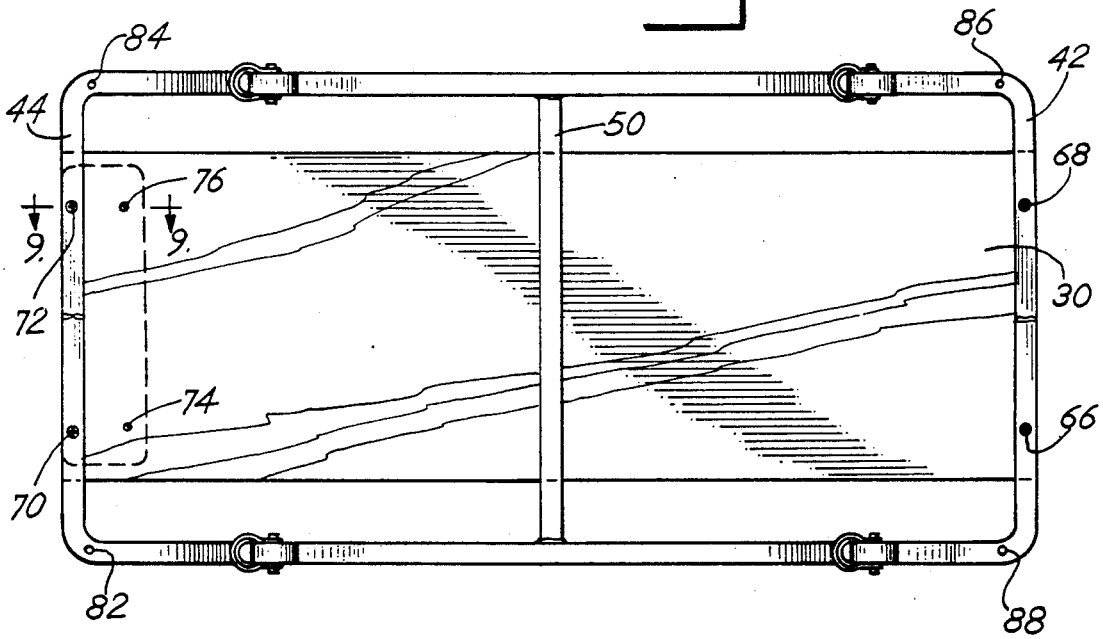
FIG. 8 is a bottom elevation view of FIG. 2.

FIG. 8 is a bottom elevation view of creeper 28. Rectangular platform 30 is preferably a five ply, plywood panel having dimensions of 11.87 inches×41.81 inches×0.50 inches. Platform 30 is fastened to ends 42 and 44, by screws 66–72. Supplemental support 50 provides support to the middle section of platform 30. Platform 30 provides sufficient flexibility to withstand the abuse encountered in a work environment. However, any of a number of resilient materials such as plastic may be employed. FIG. 8 also illustrates moisture drainage holes 82–88 located at the four corners of the bottom side of frame 34. Platform 30 may also include a padding covered by a durable material such as vinyl.

Figure 9:
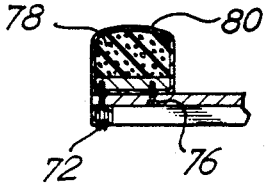
FIG. 9 is a sectional view of FIG. 8 taken along line 9—9.

FIG. 9 is a sectional view of FIG. 8 and shows headrest 32 mounted to one end of the rectangular platform 30 by screws 72–76. Head rest 32 is comprised of a padded material 78 covered by durable material 80, such as vinyl, to provide a simple and easy to clean head rest.

Various modifications of the creeper described may be employed without departing from the spirit or scope of the invention. The invention is thus to be limited only by the following claims and their equivalents.

What is claimed is:

1. An improved mechanic's creeper of the type including a platform for receiving a person in a reclined position, a frame for supporting said platform, and casters mounted on said frame for allowing said mechanic's creeper to creep, the improvement comprising in combination:

a low profile, generally planar, rectangular frame having generally parallel, spaced sides and transverse ends formed as a continuous, closed loop tubular member having an upper surface defining a platform support plane and also having four corners, the frame thereby defining a circumference, each of said sides including two, spaced, upwardly extending caster recess bends intermediate two corners of the tubular member, said bends being opposite each other, each bend formed to receive a caster and effectively position the entire rectangular frame more nearly adjacent the floor level, each bend including a generally flat section to receive a caster;

a supplemental support bracket comprising a straight, tubular member connecting the opposite parallel spaced sides of the frame intermediate the caster recess bends;

a caster mounted to the lower surface of each caster recess bend attached to the flat section;

a rectangular platform mounted to the upper surface of the ends of said generally rectangular frame, supported on the supplemental support bracket and defining a frame and a platform surface which is immediately adjacent the ground level and below the level of the caster bends along the entire circumference of the frame;

wherein said generally rectangular frame is defined by first and second U-shaped sections integrally and identically formed as substantially mirror image sections, said sections being coupled at two joints to form said continuous closed loop.

* * * * *